US010466608B2

(12) United States Patent
Tanaka

(10) Patent No.: US 10,466,608 B2
(45) Date of Patent: Nov. 5, 2019

(54) TONER

(71) Applicant: KYOCERA Document Solutions Inc., Osaka (JP)

(72) Inventor: Erika Tanaka, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/101,396

(22) Filed: Aug. 11, 2018

(65) Prior Publication Data

US 2019/0064685 A1 Feb. 28, 2019

(30) Foreign Application Priority Data

Aug. 22, 2017 (JP) ..... 2017-159228

(51) Int. Cl.
*G03G 9/093* (2006.01)

(52) U.S. Cl.
CPC ..... *G03G 9/09321* (2013.01); *G03G 9/09371* (2013.01); *G03G 9/09392* (2013.01)

(58) Field of Classification Search
CPC ..... G03G 9/09321; G03G 9/09371
See application file for complete search history.

(56) References Cited

U.S. PATENT DOCUMENTS

| | | | | |
|---|---|---|---|---|
| 5,334,480 | A * | 8/1994 | Inaba | G03G 9/09321 430/108.22 |
| 2011/0104608 | A1* | 5/2011 | Nakajima | G03G 9/08708 430/109.31 |
| 2014/0030648 | A1* | 1/2014 | Miyamoto | G03G 9/09321 430/110.2 |
| 2014/0134529 | A1* | 5/2014 | Yamada | G03G 9/0904 430/107.1 |
| 2014/0193750 | A1* | 7/2014 | Mizutani | G03G 9/08755 430/105 |
| 2016/0274479 | A1* | 9/2016 | Tsujihiro | G03G 9/09321 |
| 2017/0248860 | A1* | 8/2017 | Nishitera | G03G 9/0819 |
| 2018/0210357 | A1* | 7/2018 | Tsujihiro | G03G 9/09328 |
| 2018/0224765 | A1* | 8/2018 | Tanaka | G03G 9/09342 |

FOREIGN PATENT DOCUMENTS

| | | | | |
|---|---|---|---|---|
| JP | 55089855 | A * | 7/1980 | B01J 13/14 |
| JP | 63050859 | A * | 3/1988 | G03G 9/08726 |
| JP | 2004-212508 | A | 7/2004 | |
| JP | 2015125266 | A * | 7/2015 | |

OTHER PUBLICATIONS

English language machine translation of JP 2015-125266 (Jul. 2015).*

* cited by examiner

*Primary Examiner* — Christopher D Rodee

(74) *Attorney, Agent, or Firm* — Studebaker & Brackett PC

(57) ABSTRACT

Toner particles each include a toner mother particle and an external additive. The toner mother particle includes a toner core containing a binder resin and a shell layer covering a surface of the toner core. The external additive includes a plurality of external addition resin particles. The external addition resin particles are each present on a surface of the shell layer. The shell layer contains a specific vinyl resin. The toner core and each resin particle are bonded together through a covalent bond within the shell layer. A detachment rate of the resin particles is lower than 5%. The vinyl resin include constitutional units represented by formulas (1-1) to (1-3). The atomic groups $X^1$ and $X^2$ included in the constitutional units represented by the respective formulas (1-1) and (1-2) are each derived from N-methylol group and represented by —$NHCH_2O$—.

(1-1)

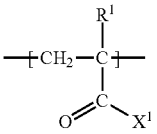

(1-2)

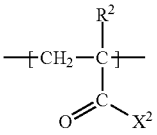

(1-3)

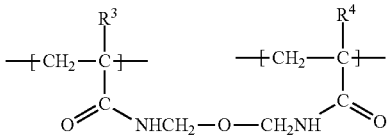

8 Claims, No Drawings

TONER

INCORPORATION BY REFERENCE

The present application claims priority under 35 U.S.C. § 119 to Japanese Patent Application No. 2017-159228, filed on Aug. 22, 2017. The contents of this application are incorporated herein by reference in their entirety.

BACKGROUND

The present disclosure relates to a toner. Specifically, the present disclosure relates to a toner in which resin particles are externally added.

It is known to produce a toner by externally adding a silica powder to surfaces of toner mother particles by a plurality of steps.

SUMMARY

A toner according to the present disclosure is positively chargeable. Specifically, the toner includes a plurality of toner particles. The toner particles each include a toner mother particle and an external additive. The toner mother particle includes a toner core containing a binder resin and a shell layer covering a surface of the toner core. The external additive includes a plurality of resin particles containing a resin. The resin particles are each present on a surface of the shell layer. The shell layer contains a vinyl resin. The vinyl resin includes a constitutional unit represented by formula (1-1) shown below, a constitutional unit represented by formula (1-2) shown below, and a constitutional unit represented by formula (1-3) shown below. An atomic group $X^1$ included in the constitutional unit represented by the formula (1-1) and an atomic group $X^2$ included in the constitutional unit represented by the formula (1-2) are each derived from an N-methylol group and represented by —$NHCH_2O$—. An available bond of an oxygen atom located at a terminal of the atomic group $X^1$ is connected to an atom constituting the binder resin. An available bond of an oxygen atom located at a terminal of the atomic group $X^2$ is connected to an atom constituting the resin contained in the resin particles. The toner core and each of the resin particles are bonded together through a covalent bond within the shell layer. The covalent bond includes the atomic group $X^1$ and the atomic group $X^2$. A detachment rate of the resin particles from the toner mother particles measured after irradiation of the toner with ultrasonic waves having a high-frequency output of 100 W and an oscillation frequency of 50 kHz for 10 minutes is lower than 5%.

(1-1)

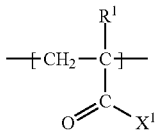

In formula (1-1), $R^1$ represents a hydrogen atom or an alkyl group optionally substituted with a substituent.

(1-2)

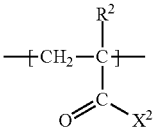

In formula (1-2), $R^2$ represents a hydrogen atom or an alkyl group optionally substituted with a substituent.

(1-3)

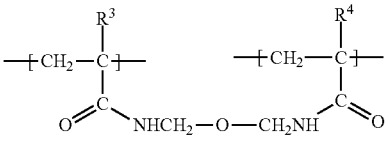

In formula (1-3), $R^3$ and $R^4$ each represent, independently of each other, a hydrogen atom or an alkyl group optionally substituted with a substituent.

DETAILED DESCRIPTION

The following describes an embodiment of the present disclosure. Evaluation results (values indicating shape, physical properties, or the like) for particles are each a number average of values measured for an appropriate number of the particles, unless otherwise stated. Examples of particles include toner cores, toner mother particles, an external additive, and a toner. The term toner mother particles refers to toner particles before attachment of an external additive thereto.

A number average particle diameter of particles is a number average value of equivalent circle diameters of primary particles (Heywood diameters: diameters of circles having the same areas as projected areas of particles) measured using a microscope, unless otherwise stated. A measurement value for a volume median diameter ($D_{50}$) of particles is a value measured based on Coulter principle (electrical sensing zone method) using "Coulter Counter Multisizer 3" manufactured by Beckman Coulter, Inc., unless otherwise stated.

Measurement values for an acid value and a hydroxyl value are each a value measured in accordance with "Japanese Industrial Standard (JIS) K0070-1992", unless otherwise stated. Measurement values for a number average molecular weight (Mn) and a mass average molecular weight (Mw) are each a value measured using gel permeation chromatography, unless otherwise stated. A glass transition point (Tg) and a melting point (Mp) are each a value measured using a differential scanning calorimeter ("DSC-6220" manufactured by Seiko Instruments Inc.), unless otherwise stated. A softening point (Tm) is a value measured using a capillary rheometer ("CFT-500D" manufactured by Shimadzu Corporation), unless otherwise stated.

Strength of chargeability refers to a degree of chargeability in triboelectric charging, unless otherwise stated. For example, a toner can be triboelectrically charged by mixing and stirring the toner with a standard carrier (anionic property: N-01, cationic property: P-01) provided by The Imaging Society of Japan. A surface potential of toner particles is measured before and after triboelectric charging using for example a kelvin probe force microscope (KFM). A portion where the potential varies greater between before and after triboelectric charging has stronger chargeability.

In the following description, the term "-based" may be appended to the name of a chemical compound in order to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof. The term "(meth)acryl" may be used as a generic term encompassing both acryl and methacryl. The term "(meth)acrylonitrile" may be used as a generic term encompassing both acrylonitrile and methacrylonitrile. The term "(meth)acrylate" may be used as a generic term encompassing both acrylate and methacrylate.

A toner according to the present embodiment is an electrostatic latent image developing toner that can be suitably used for development of electrostatic latent images. The toner according to the present embodiment may constitute a one-component developer. Alternatively, the toner may constitute a two-component developer together with a carrier. When the toner constitutes a one-component developer, the toner is positively charged through friction with a blade within a development device. When the toner constitutes a two-component developer, the toner is positively charged through friction with a carrier within a development device.

The toner according to the present embodiment can be used for image formation for example in an electrophotographic apparatus (image forming apparatus). The following describes an example of image formation methods performed by an electrophotographic apparatus.

First, an electrostatic latent image is formed on a photosensitive member based on image data. Next, the formed electrostatic latent image is developed with toner. In the development process, toner on a development sleeve (for example, a surface layer portion of a development roller within a development device) disposed in the vicinity of the photosensitive member is attached to the electrostatic latent image to form a toner image on the photosensitive member. In a subsequent transfer process, the toner image on the photosensitive member is transferred onto a recording medium (for example, paper). Thereafter, the toner is fixed to the recording medium by heating the toner. As a result, an image is formed on the recording medium.

[Features of Toner]

The toner according to the present embodiment is positively chargeable and includes a plurality of toner particles. The toner particles each include a toner mother particle and an external additive. The toner mother particles each include a toner core and a shell layer. The toner core contains a binder resin. The shell layer covers a surface of the toner core. The external additive includes a plurality of resin particles containing a resin. In the following description, "resin particles included in the external additive" will be referred to as "external addition resin particles". The external addition resin particles are each present on a surface of the shell layer. The toner core and each external addition resin particle are bonded together through a covalent bond within the shell layer. A rate of detachment of the external addition resin particles from the toner mother particles measured after irradiation of the toner with ultrasonic waves having a high-frequency output of 100 W and an oscillation frequency of 50 kHz for 10 minutes (hereinafter simply referred to as a "detachment rate of the external addition resin particles") is lower than 5%.

In the toner according to the present embodiment, the toner core and each external addition resin particle are bonded together through a covalent bond (hereinafter referred to as a "specific covalent bond") within the shell layer. In this configuration, the detachment rate of the external addition resin particles tends to be lower than 5.0%. In a configuration in which the toner core and each external addition resin particle are not bonded together through the specific covalent bond, the detachment rate of the external addition resin particles tends to be equal to or higher than 5.0%. Even in a configuration in which the external addition resin particles are bonded to the surface of the shell layer by thermal fusion, it is difficult to attain a detachment rate of the external addition resin particles of lower than 5.0%. Therefore, whether or not the toner core and each external addition resin particle are bonded together through the specific covalent bond can be inferred by measuring the detachment rate of the external addition resin particles. Specifically, when the measured detachment rate of the external addition resin particles is equal to or higher than 5.0%, it can be inferred that the toner core and each external addition resin particle are not bonded together through the specific covalent bond. By contrast, when the measured detachment rate of the external addition resin particles is lower than 5.0%, it can be inferred that the toner core and each external addition resin particle are bonded together through the specific covalent bond. The detachment rate of the external addition resin particles is measured by a method described later in Examples or a method in accordance therewith.

In the toner according to the present embodiment, the detachment rate of the external addition resin particles tends to be lower than 5.0%. Therefore, it is possible to prevent detachment of the external addition resin particles from the surface of the shell layer during image formation. Accordingly, the toner is excellent in heat resistance, thermal-stress resistance, and charge stability.

When detachment of the external addition resin particles from the surface of the shell layer is prevented during image formation, attachment of the external addition resin particles to a surface of another member can be prevented. Consequently, it is possible to prevent a situation in which the toner mother particles (particularly, a resin component of the toner mother particles) are attached to the surface of the other member through external addition resin particles being attached to the surface of the other member. Therefore, contamination of the surface of the other member by the external addition resin particles or the toner mother particles can be prevented.

When contamination of for example a surface of the development sleeve is prevented, it is possible to prevent the surface of the development sleeve from having non-uniform resistance. Consequently, it is possible to prevent variation in an amount of toner carried and conveyed on the surface of the development sleeve (i.e., toner conveyance amount). As a result, non-uniform development can be prevented. Also, when contamination of the photosensitive member is prevented, it is possible to prevent non-uniform transfer to the recording medium. Thus, non-uniform transfer can be prevented. Further, in a situation in which the toner according to the present embodiment constitutes a two-component developer, contamination of surfaces of carrier particles can be prevented. Consequently, it is possible to prevent reduction in an amount of charge of the toner. Therefore, the toner is excellent in developability.

As described above, the toner according to the present embodiment is excellent in heat resistance, thermal-stress resistance, charge stability, and developability. Therefore, use of the toner enables stable image formation for an extended period of time.

The following further describes the shell layer. The shell layer contains a vinyl resin. Typically, a vinyl resin is a homopolymer of a vinyl compound or a copolymer of monomers including a vinyl compound. A vinyl compound has at least one functional group among a vinyl group ($CH_2$═CH—), a vinylidene group ($CH_2$═C<), and a vinylene group (—CH═CH—) in a molecule thereof. The vinyl compound becomes a macromolecule (vinyl resin) when addition polymerization reaction occurs through cleavage of a carbon-to-carbon double bond (C═C) included in a functional group such as the vinyl group.

In the present embodiment, the vinyl resin includes a constitutional unit represented by formula (1-1) shown below (hereinafter referred to as a "constitutional unit (1-1)"), a constitutional unit represented by formula (1-2) shown below (hereinafter referred to as a "constitutional unit (1-2)"), and a constitutional unit represented by formula (1-3) shown below (hereinafter referred to as a "constitutional unit (1-3)"). In the following description, the "vinyl resin including the constitutional unit (1-1), the constitutional unit (1-2), and the constitutional unit (1-3)" will be referred to as a "specific vinyl resin".

(1-1)

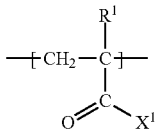

In formula (1-1), $R^1$ represents a hydrogen atom or an alkyl group optionally substituted with a substituent. Examples of alkyl groups include a straight-chain alkyl group, a branched-chain alkyl group, and a cyclic alkyl group. An example of the alkyl group optionally substituted with a substituent is a phenyl group. Preferably, $R^1$ represents a hydrogen atom, a methyl group, an ethyl group, or an isopropyl group. $X^1$ will be described later.

(1-2)

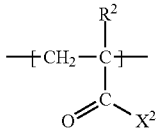

In formula (1-2), $R^2$ represents a hydrogen atom or an alkyl group optionally substituted with a substituent. Examples of alkyl groups include a straight-chain alkyl group, a branched-chain alkyl group, and a cyclic alkyl group. An example of the alkyl group optionally substituted with a substituent is a phenyl group. Preferably, $R^2$ represents a hydrogen atom, a methyl group, an ethyl group, or an isopropyl group. $X^2$ will be described later.

(1-3)

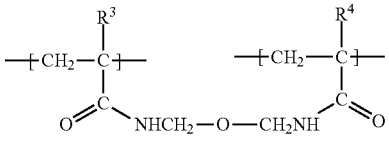

In formula (1-3), $R^3$ and $R^4$ each represent, independently of each other, a hydrogen atom or an alkyl group optionally substituted with a substituent. Examples of alkyl groups include a straight-chain alkyl group, a branched-chain alkyl group, and a cyclic alkyl group. An example of the alkyl group optionally substituted with a substituent is a phenyl group. Preferably, $R^3$ and $R^4$ each represent, independently of each other, a hydrogen atom, a methyl group, an ethyl group, or an isopropyl group.

The covalent bond bonding the toner core and each external addition resin particle together within the shell layer (hereinafter referred to as the "specific covalent bond") has an atomic group $X^1$ included in the constitutional unit (1-1) and an atomic group $X^2$ included in the constitutional unit (1-2). The atomic group $X^1$ and the atomic group $X^2$ are each derived from an N-methylol group and represented by —$NHCH_2O$—. An available bond of an oxygen atom located at a terminal of the atomic group $X^1$ is connected to an atom constituting the binder resin. An available bond of an oxygen atom located at a terminal of the atomic group $X^2$ is connected to an atom constituting the resin contained in the external addition resin particles (hereinafter may be referred to as an "external addition resin"). Therefore, the constitutional unit (1-1) can be represented by formula (1-1A) shown below and the constitutional unit (1-2) can be represented by formula (1-2A) shown below. In formula (1-1A), $12^1$ is as described above and the available bond of the oxygen atom is connected to the atom constituting the binder resin. In formula (1-2A), $R^2$ is as described above and the available bond of the oxygen atom is connected to the atom constituting the external addition resin.

(1-1A)

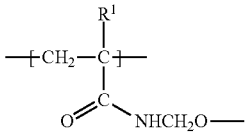

(1-2A)

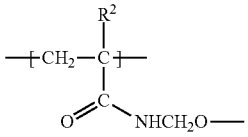

Since the specific vinyl resin includes the constitutional unit (1-1), the constitutional unit (1-2), and the constitutional unit (1-3), the specific vinyl resin has nitrogen atoms (more specifically, nitrogen atoms derived from the N-methylol groups). Therefore, the positively chargeable toner according to the present embodiment is excellent in charge characteristics.

The following further describes the specific vinyl resin. The specific vinyl resin is preferably a copolymer of a first monomer and a second monomer. The first monomer is preferably at least one vinyl compound represented by formula (1-4) shown below. Here, it is noted that each of the constitutional unit (1-1), the constitutional unit (1-2), and the constitutional unit (1-3) is a constitutional unit derived from the first monomer. The second monomer is preferably at least one monomer selected from the group consisting of at least one alkyl (meth)acrylate-based monomer and at least one styrene-based monomer. The term alkyl (meth)acrylate-based monomer refers to (meth)acrylate-based monomer having at least one species of alkyl group in a molecule thereof.

(1-4)

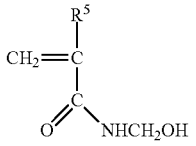

In formula (1-4), $R^5$ represents a hydrogen atom or an alkyl group optionally substituted with a substituent. Examples of alkyl groups include a straight-chain alkyl group, a branched-chain alkyl group, and a cyclic alkyl group. An example of the alkyl group optionally substituted with a substituent is a phenyl group. Preferably, $R^5$ represents a hydrogen atom, a methyl group, an ethyl group, or an isopropyl group.

An amount of the first monomer and an amount of the second monomer are each preferably adjusted such that a ratio of the amount of the first monomer to a sum of the amount of the first monomer and the amount of the second monomer (hereinafter simply referred to as a "first monomer blending ratio") is at least 10% by mass and no greater than 60% by mass. As the first monomer blending ratio increases, the number of the specific covalent bonds within the shell layer tends to increase. As a result, the detachment rate of the external addition resin particles tends to be lower than 5.0%. Also, as the first monomer blending ratio increases, a unit derived from a homopolymer of the second monomer or a unit derived from a copolymer of monomers including the second monomer tends to be cross-linked by at least one constitutional unit selected from the group consisting of the constitutional unit (1-1), the constitutional unit (1-2), and the constitutional unit (1-3). The above results in further improvement in heat resistance and thermal-stress resistance of the toner. Note that when the first monomer blending ratio is excessively high, cross-linking density of the specific vinyl resin may become excessively high, resulting in poor low-temperature fixability of the toner.

[Method for Producing Toner]

A method for producing the toner according to the present embodiment includes production of composite particles. The method for producing the toner according to the present embodiment may further include external addition. The composite particles each include the toner mother particle and the external addition resin particles, but do not include external additive particles other than the external addition resin particles (for example, silica particles or metal oxide particles). Also, in each composite particle, the toner core and each external addition resin particle are bonded together through the specific covalent bond. Note that in a configuration in which toner particles do not include external additive particles other than the external addition resin particles, the composite particles are equivalent to the toner particles. Also, toner particles produced at the same time are thought to have substantially the same structure as one another.

<Production of Composite Particles>

Production of the composite particles include: production of the toner cores; preparation of a dispersion of the external addition resin particles; preparation of a shell layer formation liquid; and formation of the shell layer.

(Production of Toner Cores)

In production of the toner cores, toner cores having surfaces substituted with a hydroxyl group are produced. The toner cores can be easily produced by a known pulverization method or a known aggregation method. When the toner cores are produced by either of these methods, the toner cores are preferably produced with at least one resin having a hydroxyl value of at least 1 mgKOH/g and no greater than 50 mgKOH/g. The above facilitates production of the toner cores having surfaces substituted with the hydroxyl group. More preferably, the toner cores are produced with at least one resin having a hydroxyl value of at least 10 mgKOH/g and no greater than 40 mgKOH/g. In the following description, a "hydroxyl group present at the surfaces of the toner cores" may be referred to as a "first hydroxyl group".

(Preparation of Dispersion of External Addition Resin Particles)

In preparation of the dispersion of the external addition resin particles, a dispersion of resin particles having surfaces substituted with a hydroxyl group is prepared. Specifically, a resin (more specifically, the external addition resin) is preferably synthesized in a dispersion medium through various polymerization reactions. More preferably, a resin having a hydroxyl value of at least 1 mgKOH/g and no greater than 30 mgKOH/g is synthesized in a dispersion medium through various polymerization reactions. The above facilitates production of the resin particles having surfaces substituted with the hydroxyl group. Homopolymerization of a monomer or copolymerization of two or more monomers may be caused in the dispersion medium. Polymerization of one or more monomers may be caused in the presence of a polymerization initiator in the dispersion medium. No specific limitation is placed on conditions for the polymerization reactions. Water can be used as the dispersion medium. Examples of water include ion exchanged water. In the following description, a "hydroxyl group present at the surfaces of the external addition resin particles" may be referred to as a "second hydroxyl group".

(Preparation of Shell Layer Formation Liquid)

In preparation of the shell layer formation liquid, a dispersion of shell resin particles is prepared. Specifically, a shell resin is preferably synthesized in an organic solvent through various polymerization reactions. More specifically, a resin including a constitutional unit represented by formula (1-5) shown below (hereinafter referred to as a "constitutional unit (1-5)") is preferably synthesized in an organic solvent through various polymerization reactions. More preferably, synthesis is carried out with monomers including the first monomer and the second monomer through various polymerization reactions in the organic solvent. Further preferably, the amount of the first monomer and the amount of the second monomer are each adjusted such that the first monomer blending ratio is at least 10% by mass and no greater than 60% by mass. Polymerization of the monomers may be caused in the presence of a polymerization initiator. No specific limitation is placed on conditions for the polymerization reactions. Examples of organic solvents that can be used include n-propanol. A dispersion including the organic solvent as the dispersion medium is obtained as described above.

(1-5)

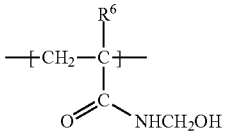

In formula (1-5), $R^6$ represents a hydrogen atom or an alkyl group optionally substituted with a substituent. Examples of alkyl groups include a straight-chain alkyl group, a branched-chain alkyl group, and a cyclic alkyl group. An example of the alkyl group optionally substituted with a substituent is a phenyl group. Preferably, $R^6$ represents a hydrogen atom, a methyl group, an ethyl group, or an isopropyl group.

Next, a solid component is collected from the dispersion and dispersed in another dispersion medium. No specific limitation is placed on a method for collecting the solid component from the dispersion. The other dispersion medium preferably includes water, and more preferably includes ion exchanged water. The solid component may be crashed before being dispersed in the other dispersion medium. Alternatively, the solid component may be subjected to high-speed sheering in the other dispersion medium. The dispersion of the shell resin particles (the shell layer formation liquid) is obtained as described above.

(Formation of Shell Layer)

In formation of the shell layer, the shell layer is formed to cover the surface of each toner core. Specifically, the toner cores, the dispersion of the external addition resin particles, and the shell layer formation liquid are mixed at a specific temperature. Through the above, the shell layer is formed. Also, each toner core and the external addition resin particles are bonded together through the specific covalent bond.

More specifically, the toner cores, the dispersion of the external addition resin particles, and the shell layer formation liquid are initially mixed to obtain a dispersion. The shell resin particles and the external addition resin particles are attached to the surface of each toner core in the dispersion. The shell resin particles have a larger diameter than the external addition resin particles. Therefore, the shell resin particles tend to be present near the surface of the toner core and the external addition resin particles tend to be present further radially outward from the toner core than the shell resin particles. Even when the external addition resin particles are attached to the surface of the toner core before the shell resin particles, the external addition resin particles tend to be detached from the surface of the toner core by collision of the shell resin particles with the external addition resin particles attached to the surface of the toner core. As a result, the shell resin particles tend to be preferentially present near the surface of the toner core than the external addition resin particles.

In order to uniformly attach the shell resin particles to the surface of each toner core, it is preferable to highly disperse the toner cores in the dispersion. In order to highly disperse the toner cores in the dispersion, a surfactant may be added to the dispersion or the dispersion may be stirred using a powerful stirrer (for example, "Hivis Disper Mix" manufactured by PRIMIX Corporation).

Next, the temperature of the dispersion is increased up to a specific temperature at a specific heating rate while the dispersion is stirred. Thereafter, the temperature of the dispersion is kept at the specific temperature for a specific period of time while the dispersion is stirred. The specific temperature is equal to or higher than a temperature at which the atomic group $X^1$ is formed through reaction between the first hydroxyl group and an N-methylol group (—$NHCH_2OH$) included in the constitutional unit (1-5) and equal to or higher than a temperature at which the atomic group $X^2$ is formed through reaction between the second hydroxyl group and another N-methylol group included in the constitutional unit (1-5). Therefore, the following reaction is thought to proceed during the time when the temperature of the dispersion is kept at the specific temperature. Specifically, some of a plurality of N-methylol groups included in the constitutional unit (1-5) reacts with the first hydroxyl group to form the constitutional unit (1-1) and some of the N-methylol groups reacts with the second hydroxyl group to form the constitutional unit (1-2). Among the plurality of N-methylol groups included in the constitutional unit (1-5), N-methylol groups that react with neither the first hydroxyl group nor the second hydroxyl group react with one another (formation of the constitutional unit (1-3)). Through the above, the shell layer is formed. Also, simultaneously with formation of the shell layer, the toner core and each external addition resin particle are bonded together through the specific covalent bond. Then, a plurality of the composite particles are obtained by performing solid-liquid separation on the dispersion, washing, and drying.

The specific temperature is preferably selected from a range of at least 40° C. and no higher than 100° C. When the specific temperature is at least 40° C., reaction between the N-methylol group and each of the first hydroxyl group and the second hydroxyl group readily proceeds. When the specific temperature is higher than 100° C., the toner cores may agglomerate together in the dispersion. Agglomerated toner cores may fuse together. As a result, it becomes difficult to uniformly attach a shell material to the surface of each toner core.

The specific heating rate is preferably selected for example from a range of at least 0.1° C./minute and no higher than 3° C./minute. The specific period of time is preferably selected for example from a range of at least 30 minutes and no longer than 4 hours. The dispersion is preferably stirred at a rotational speed of at least 50 rpm and no greater than 500 rpm. Under the above conditions, reaction between the N-methylol group and each of the first hydroxyl group and the second hydroxyl group readily proceeds.

<External Addition>

External additive particles other than the external addition resin particles are mixed with the composite particles using a mixer (for example, an FM mixer manufactured by Nippon Coke & Engineering Co., Ltd.). As a result, a toner including a plurality of toner particles is obtained.

[Examples of Materials of Toner]

<Toner Cores>

The binder resin is typically a main component (for example, at least 85% by mass) of the toner cores. Therefore, properties of the binder resin are thought to have great influence on overall properties of the toner cores. The properties of the binder resin (specific examples include hydroxyl value, acid value, Tg, and Tm) can be adjusted through use of a plurality of resins in combination as the binder resin. For example, in a configuration in which the binder resin is substituted with an ester group, a hydroxyl group, an ether group, an acid group, or a methyl group, the toner cores have a strong tendency to be anionic. In a configuration in which the binder resin is substituted with an amino group, the toner cores have a strong tendency to be cationic.

The toner cores may contain not only the binder resin but also at least one of a colorant, a releasing agent, and a charge control agent. The following describes these components in order.

(Binder Resin)

In a configuration in which the binder resin has a hydroxyl value greater than 0 mgKOH/g, the atomic group $X^1$ is easily formed. Preferably, the binder resin has a hydroxyl value of at least 1 mgKOH/g and no greater than 50 mgKOH/g. As the hydroxyl value of the binder resin becomes greater, reaction between the first hydroxyl group and the N-methylol group tends to proceed more readily. Consequently, the atomic group $X^1$ tends to be easily formed. In a configuration in which the binder resin has an excessively great hydroxyl value, charge stability of the toner may become low. For example, an excessively great hydroxyl value of the binder resin may cause decrease in an amount of charge of the toner in image formation performed in a high humidity environment. More preferably, the binder resin has a hydroxyl value of at least 10 mgKOH/g and no greater than 40 mgKOH/g.

More specifically, the binder resin preferably includes at least one resin having a hydroxyl value of at least 1 mgKOH/g and no greater than 50 mgKOH/g. In this case, the binder resin tends to have a hydroxyl value of at least 1 mgKOH/g and no greater than 50 mgKOH/g. More specifically, the binder resin preferably includes at least one resin selected from the group consisting of a polyester resin having a hydroxyl value of at least 1 mgKOH/g and no greater than 50 mgKOH/g and a styrene-acrylic acid-based resin having a hydroxyl value of at least 1 mgKOH/g and no greater than 50 mgKOH/g.

A polyester resin is a copolymer of at least one alcohol and at least one carboxylic acid. Examples of alcohols that can be used for synthesis of the polyester resin include dihydric alcohols and tri- or higher-hydric alcohols listed below. Examples of dihydric alcohols that can be used include diols and bisphenols. Examples of carboxylic acids that can be used for synthesis of the polyester resin include dibasic carboxylic acids and tri- or higher-basic carboxylic acids listed below.

Examples of preferable diols include aliphatic diols. Examples of preferable aliphatic diols include diethylene glycol, triethylene glycol, neopentyl glycol, 1,2-propanediol, α,ω-alkanediols, 2-butene-1,4-diol, 1,4-cyclohexanedimethanol, dipropylene glycol, polyethylene glycol, polypropylene glycol, and polytetramethylene glycol. Examples of preferable α,ω-alkanediols include ethylene glycol, 1,3-propanediol, 1,4-butanediol, 1,5-pentanediol, 1,6-hexanediol, 1,7-heptanediol, 1,8-octanediol, 1,9-nonanediol, and 1,12-dodecanediol.

Examples of preferable bisphenols include bisphenol A, hydrogenated bisphenol A, bisphenol A ethylene oxide adduct, and bisphenol A propylene oxide adduct.

Examples of preferable tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of preferable dibasic carboxylic acids include aromatic dicarboxylic acids, α,ω-alkanedicarboxylic acids, unsaturated dicarboxylic acids, and cycloalkane dicarboxylic acids. Examples of preferable aromatic dicarboxylic acids include phthalic acid, terephthalic acid, and isophthalic acid. Examples of preferable α,ω-alkanedicarboxylic acids include malonic acid, succinic acid, adipic acid, suberic acid, azelaic acid, sebacic acid, and 1,10-decanedicarboxylic acid. Examples of preferable unsaturated dicarboxylic acids include maleic acid, fumaric acid, citraconic acid, itaconic acid, and glutaconic acid. Examples of preferable cycloalkane dicarboxylic acids include cyclohexanedicarboxylic acid.

Examples of preferable tri- or higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

A styrene-acrylic acid-based resin is a copolymer of at least one styrene-based monomer and at least one acrylic acid-based monomer. Examples of styrene-based monomers preferable for synthesis of the styrene-acrylic acid-based resin include styrene, alkylstyrenes, hydroxystyrenes, and halogenated styrenes. Examples of preferable alkylstyrenes include α-methylstyrene, m-methylstyrene, p-methylstyrene, p-ethylstyrene, and 4-tert-butylstyrene. Examples of preferable hydroxystyrenes include p-hydroxystyrene and m-hydroxystyrene. Examples of preferable halogenated styrenes include α-chlorostyrene, o-chlorostyrene, m-chlorostyrene, and p-chlorostyrene.

Examples of acrylic acid-based monomers preferable for synthesis of the styrene-acrylic acid-based resin include (meth)acrylic acid, (meth)acrylamide, (meth)acrylonitrile, (meth)acrylic alkyl esters, and (meth)acrylic hydroxyalkyl esters. Examples of preferable (meth)acrylic alkyl esters include methyl (meth)acrylate, ethyl (meth)acrylate, n-propyl (meth)acrylate, iso-propyl (meth)acrylate, n-butyl (meth)acrylate, iso-butyl (meth)acrylate, and 2-ethylhexyl (meth)acrylate. Examples of preferable (meth)acrylic hydroxyalkyl esters include 2-hydroxyethyl (meth)acrylate, 3-hydroxypropyl (meth)acrylate, 2-hydroxypropyl (meth) acrylate, and 4-hydroxybutyl (meth)acrylate.

The binder resin may further include a resin (additional resin) other than the polyester resin and the styrene-acrylic acid-based resin. The additional resin may have a hydroxyl value of 0 mgKOH/g. The additional resin may be a thermoplastic resin (additional thermoplastic resin) other than the polyester resin and the styrene-acrylic acid-based resin. Examples of additional thermoplastic resins that can be used include styrene-based resins, acrylic acid-based resins, olefin-based resins, vinyl resins, polyamide resins, and urethane resins. Examples of acrylic acid-based resins that can be used include polymers of acrylic acid esters and polymers of methacrylic acid esters. Examples of olefin-based resins that can be used include polyethylene resins and polypropylene resins. Examples of vinyl resins that can be used include vinyl chloride resins, polyvinyl alcohols, vinyl ether resins, and N-vinyl resins. Copolymers of the above-listed resins, that is, copolymers obtained through introduction of a repeating unit into the above-listed resins may also be used as additional thermoplastic resins. For example, a styrene-butadiene-based resin may be used as an additional thermoplastic resin.

(Colorant)

A known pigment or dye that matches the color of the positively chargeable toner can be used as a colorant. The amount of the colorant is preferably at least 1 part by mass and no greater than 20 parts by mass relative to 100 parts by mass of the binder resin in order to form high quality images using the positively chargeable toner.

The toner cores may contain a black colorant. Examples of black colorants include carbon black. Alternatively, a colorant adjusted to a black color using a yellow colorant, a magenta colorant, and a cyan colorant may be used as the black colorant.

The toner cores may contain a non-black colorant such as a yellow colorant, a magenta colorant, and a cyan colorant.

At least one compound selected from the group consisting of condensed azo compounds, isoindolinone compounds, anthraquinone compounds, azo metal complexes, methine compounds, and arylamide compounds can for example be used as the yellow colorant. Specific examples of yellow colorants that can be used include C. I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, or 194), Naphthol Yellow S, Hansa Yellow G, and C.I. Vat Yellow.

At least one compound selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds can for example be used as the magenta colorant. Specific examples of magenta colorants that can be used include C. I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, or 254).

At least one compound selected from the group consisting of copper phthalocyanine compounds, anthraquinone compounds, and basic dye lake compounds can for example be used as the cyan colorant. Specific examples of cyan colorants that can be used include C. I. Pigment Blue (1, 7, 15, 15:1, 15:2, 15:3, 15:4, 60, 62, or 66), Phthalocyanine Blue, C.I. Vat Blue, and C.I. Acid Blue.

(Releasing Agent)

A releasing agent is used for example in order to improve fixability or hot offset resistance of the positively chargeable toner. In order to produce strongly cationic toner cores, the toner cores are preferably produced with a cationic wax.

Examples of preferable releasing agents include aliphatic hydrocarbon waxes, plant waxes, animal waxes, mineral waxes, waxes containing a fatty acid ester as a main component, and waxes in which a fatty acid ester is partially or completely deoxidized. Examples of preferable aliphatic hydrocarbon waxes include low molecular weight polyethylene, low molecular weight polypropylene, polyolefin copolymer, polyolefin wax, microcrystalline wax, paraffin wax, and Fischer-Tropsch wax. Oxides of these waxes are included in aliphatic hydrocarbon waxes. Examples of preferable plant waxes include candelilla wax, carnauba wax, Japan wax, jojoba wax, and rice wax. Examples of preferable animal waxes include beeswax, lanolin, and spermaceti. Examples of preferable mineral waxes include ozokerite, ceresin, and petrolatum. Examples of preferable waxes containing a fatty acid ester as a main component include montanic acid ester wax and castor wax. A wax may be used alone or a plurality of waxes may be used in combination.

A compatibilizer may be added to the toner cores in order to improve compatibility between the binder resin and the releasing agent.

(Charge Control Agent)

A charge control agent is used for example in order to improve charge stability or a charge rise characteristic of the positively chargeable toner. The charge rise characteristic of the positively chargeable toner is an indicator as to whether or not the positively chargeable toner can be charged to a specific charge level in a short period of time. The toner cores can be made more strongly cationic through inclusion of a positively chargeable charge control agent in the toner cores.

<Shell Layer>

The shell layer contains the specific vinyl resin. The specific vinyl resin includes the constitutional unit (1-1), the constitutional unit (1-2), and the constitutional unit (1-3). The specific vinyl resin may further include a constitutional unit derived from a vinyl compound other than the first monomer and the second monomer.

The first monomer is preferably N-methylol(meth)acrylamide. The second monomer is preferably an alkyl (meth) acrylate-based monomer and/or a styrene-based monomer. Stress resistance of the toner tends to be improved when an alkyl (meth)acrylate-based monomer and a styrene-based monomer are used in combination as the second monomer. Examples of stress resistance of the toner include thermal-stress resistance of the toner.

The alkyl (meth)acrylate-based monomer is preferably at least one monomer selected for example from the group consisting of methyl (meth)acrylate, ethyl (meth)acrylate, n-propyl (meth)acrylate, iso-propyl (meth)acrylate, n-butyl (meth)acrylate, iso-butyl (meth)acrylate, and 2-ethylhexyl (meth)acrylate. More preferably, the alkyl (meth)acrylate-based monomer is methyl (meth)acrylate. When methyl (meth)acrylate is used as the alkyl (meth)acrylate-based monomer, the resultant toner is excellent in low-temperature fixability. Styrene-based monomers that can be used as the second monomer are the styrene-based monomers listed above in (Binder Resin).

<External Additive>

Unlike internal additives, an external additive is not present within the toner mother particles, and is selectively present only on surfaces of the toner mother particles. The external additive includes a plurality of the external addition resin particles. When the amount of the external addition resin particles is excessively small, heat resistance, thermal-stress resistance, or charge stability of the toner may be insufficient. When the amount of the external addition resin particles is excessively large, an amount of external addition resin particles that are not bonded to the toner cores may be greater than a negligible amount and the detachment rate of the external addition resin particles may be equal to or higher than 5.0%. The amount of the external addition resin particles is preferably at least 0.1 parts by mass and less than 2.5 parts by mass relative to 100 parts by mass of the toner mother particles, and more preferably at least 0.5 parts by mass and no greater than 2.4 parts by mass.

In a configuration in which the external addition resin has a hydroxyl value of greater than 0 mgKOH/g, the atomic group $X^2$ is easily formed. Preferably, the external addition resin has a hydroxyl value of at least 1 mgKOH/g and no greater than 30 mgKOH/g. As the hydroxyl value of the external addition resin becomes greater, reaction between the second hydroxyl group and the N-methylol group tends to proceed more readily. Consequently, the atomic group $X^2$ tends to be easily formed. In a configuration in which the external addition resin has an excessively great hydroxyl value, charge stability of the toner may become low. For example, an excessively great hydroxyl value of the external addition resin may cause decrease in an amount of charge of the toner in image formation performed in a high humidity environment. More preferably, the external addition resin has a hydroxyl value of at least 5 mgKOH/g and no greater than 30 mgKOH/g.

More specifically, the external addition resin preferably includes at least one resin having a hydroxyl value of at least 1 mgKOH/g and no greater than 30 mgKOH/g. In this case, the external addition resin tends to have a hydroxyl value of at least 1 mgKOH/g and no greater than 30 mgKOH/g. More specifically, the external addition resin preferably includes at least one resin selected from the group consisting of a polyester resin having a hydroxyl value of at least 1 mgKOH/g and no greater than 30 mgKOH/g and a styrene-acrylic acid-based resin having a hydroxyl value of at least 1 mgKOH/g and no greater than 30 mgKOH/g. Alcohols that can be used for synthesis of the polyester resin are the dihydric alcohols and the tri- or higher-hydric alcohols listed above in (Binder Resin). Carboxylic acids that can be used for synthesis of the polyester resin are the dibasic carboxylic acids and the tri- or higher-basic carboxylic acids listed above in (Binder Resin). Styrene-based monomers that can be used for synthesis of the styrene-acrylic acid-based resin are the styrene-based monomers listed above in (Binder Resin). Acrylic acid-based monomers that can be used for synthesis of the styrene-acrylic acid-based resin are the acrylic acid-based monomers listed above in (Binder Resin).

The external addition resin particles preferably have a number average primary particle diameter of at least 10 nm and no greater than 50 nm. As the number average primary particle diameter of the external addition resin particles becomes larger, production of the external addition resin particles tends to be facilitated more. In a configuration in which the external addition resin particles have an excessively large number average primary particle diameter, the external addition resin particles may have a tendency to be present nearer to the surface of the toner core than the shell resin particles in formation of the shell layer. More preferably, the external addition resin particles have a number average primary particle diameter of at least 10 nm and no greater than 40 nm.

The external additive may further include external additive particles (additional external additive particles) other than the external addition resin particles. The additional external additive particles preferably contain no resin, and are preferably silica particles or particles of a metal oxide. Examples of preferable metal oxides include alumina, titanium oxide, magnesium oxide, zinc oxide, strontium titanate, and barium titanate. The external additive may include one type of additional external additive particles or two or more types of additional external additive particles.

The amount of the additional external additive particles is preferably at least 0.5 parts by mass and no greater than 10 parts by mass relative to 100 parts by mass of the toner mother particles. In a configuration in which the toner particles include two or more types of the additional external additive particles, a total amount of the additional external additive particles is preferably at least 0.5 parts by mass and no greater than 10 parts by mass relative to 100 parts by mass of the toner mother particles. The additional external additive particles preferably have a particle diameter of at least 0.01 μm and no greater than 1.00 μm.

The additional external additive particles are each preferably provided at an exposed part of the surface region of the shell layer to which no external addition resin particles are attached. In the above configuration, fluidity of the toner particles is improved as well as heat resistance, thermal-stress resistance, charge stability, and developability of the toner.

EXAMPLES

The following describes Examples of the present disclosure. Table 1 shows compositions of toners according to Examples and Comparative examples. In Table 1, an amount of a solid content of each type of external additive suspensions relative to 100 parts by mass of toner mother particles is shown in the column titled "Amount" under "External additive suspension".

TABLE 1

| | Toner cores | | Shell suspension | | External additive suspension | |
|---|---|---|---|---|---|---|
| Toner | Type | Amount (g) | Type | Amount (g) | Type | Amount (parts by mass) |
| TA-1 | C-1 | 300 | S-1 | 160 | E-1 | 2.0 |
| TA-2 | C-1 | 300 | S-1 | 160 | E-1 | 1.5 |
| TA-3 | C-1 | 300 | S-1 | 160 | E-1 | 2.3 |
| TA-4 | C-1 | 300 | S-2 | 160 | E-1 | 2.0 |
| TA-5 | C-1 | 300 | S-3 | 160 | E-1 | 2.0 |
| TA-6 | C-1 | 300 | S-4 | 160 | E-1 | 2.0 |
| TA-7 | C-1 | 300 | S-5 | 160 | E-1 | 2.0 |
| TA-8 | C-2 | 300 | S-1 | 160 | E-1 | 2.0 |
| TA-9 | C-1 | 300 | S-1 | 160 | E-2 | 2.0 |
| TB-1 | C-1 | 300 | S-1 | 160 | E-1 | 2.5 |
| TB-2 | C-1 | 300 | S-6 | 160 | E-1 | 2.0 |
| TB-3 | C-3 | 300 | S-1 | 160 | E-1 | 2.0 |
| TB-4 | C-1 | 300 | S-1 | 160 | E-3 | 2.0 |

Table 2 shows compositions of binder resins used in Examples and Comparative examples. Table 3 shows compositions of PES-1, PES-2, SA-1, and SA-2 shown in Table 2.

TABLE 2

| | Binder resin Amount (parts by mass) | | | |
|---|---|---|---|---|
| Toner cores | PES-1 | PES-2 | SA-1 | SA-2 |
| C-1 | 80 | 20 | 0 | 0 |
| C-2 | 0 | 0 | 100 | 0 |
| C-3 | 0 | 0 | 0 | 100 |

TABLE 3

| | Material | Hydroxyl value (mgKOH/g) |
|---|---|---|
| PES-1 | Non-crystalline polyester resin | 41.0 |
| PES-2 | Crystalline polyester resin | 19.0 |
| SA-1 | Styrene-acrylic acid-based resin | 13.0 |
| SA-2 | Styrene-acrylic acid-based resin | 0.0 |

Table 4 shows compositions of shell suspensions S-1 to S-6 used in Examples and Comparative examples. In Table 4, N-MAM represents N-methylolacrylamide. MMA represents methyl methacrylate. St represents styrene. A number average particle diameter of each type of shell resin particles is shown in the column titled "Particle diameter".

TABLE 4

| | Shell resin particles | | | | | | |
|---|---|---|---|---|---|---|---|
| | First monomer | | Second monomer | | | | |
| | Material | Amount (parts by mass) | Material | Amount (parts by mass) | Material | Amount (parts by mass) | Particle diameter (nm) |
| S-1 | N-MAM | 30 | MMA | 70 | St | 0 | 130 |
| S-2 | N-MAM | 10 | MMA | 90 | St | 0 | 130 |
| S-3 | N-MAM | 50 | MMA | 50 | St | 0 | 130 |
| S-4 | N-MAM | 30 | MMA | 55 | St | 15 | 130 |
| S-5 | N-MAM | 30 | MMA | 0 | St | 70 | 130 |
| S-6 | N-MAM | 5 | MMA | 95 | St | 0 | 130 |

Table 5 shows compositions of external additive suspensions E-1 to E-3 used in Examples and Comparative examples. In Table 5, a number average particle diameter of each type of external addition resin particles is shown in the column titled "Particle diameter". A glass transition point of each external addition resin is shown in the column titled "Tg".

TABLE 5

| | External addition resin particles | | | |
|---|---|---|---|---|
| | Material | Hydroxyl value (mgKOH/g) | Particle diameter (nm) | Tg (° C.) |
| E-1 | Styrene-acrylic acid-based resin | 21.6 | 28 | 138 |
| E-2 | Styrene-acrylic acid-based resin | 12.9 | 28 | 138 |
| E-3 | Styrene-acrylic acid-based resin | 0.0 | 32 | 145 |

The following describes synthesis methods for the binder resins used in Examples and Comparative examples, a measurement method for hydroxyl values of the binder resins, production methods for the external additive suspensions, measurement methods for physical property values of external addition resin particles, production methods for the shell suspensions, and measurement methods for physical property values of shell resin particles in order. Next, production methods, evaluation methods, and evaluation results for toners TA-1 to TA-9 and TB-1 to TB-4 according to Examples and Comparative examples will be described in order. Note that in evaluations in which errors may occur, an evaluation value was calculated by calculating an arithmetic mean of an appropriate number of measurement values so that any errors were sufficiently small.

[Synthesis Methods for Binder Resins]

(Synthesis Method for Non-crystalline Polyester Resin PES-1)

A four-necked flask (capacity: 5 L) equipped with a thermometer (more specifically, a thermocouple), a drainage tube, a nitrogen inlet tube, and a stirrer was charged with 1,700 g of bisphenol A propylene oxide adduct, 650 g of bisphenol A ethylene oxide adduct, 500 g of n-dodecenyl succinic anhydride, 400 g of terephthalic acid, and 4 g of dibutyl tin oxide. The internal temperature of the flask was increased up to 220° C. The flask contents were caused to react for 9 hours while the internal temperature of the flask was kept at 220° C. The internal pressure of the flask was reduced to 8 kPa. The flask contents were caused to further react at the high temperature and the reduced pressure (temperature: 220° C., pressure: 8 kPa). Through the above, a non-crystalline polyester resin PES-1 was obtained. The non-crystalline polyester resin PES-1 had a softening point (Tm) of 124.8° C., a glass transition point (Tg) of 57.2° C., an acid value of 6.0 mgKOH/g, a hydroxyl value of 41.0 mgKOH/g, a number average molecular weight (Mn) of 3,737 and a mass average molecular weight (Mw) of 109,475.

(Synthesis Method for Crystalline Polyester Resin PES-2)

A four-necked flask (capacity: 5 L) equipped with a thermometer (more specifically, a thermocouple), a drainage tube, a nitrogen inlet tube, and a stirrer was charged with 990.0 g (84 parts by mole) of 1,4-butanediol, 242.0 g (11 parts by mole) of 1,6-hexanediol, 1480.0 g (100 parts by mole) of fumaric acid, and 2.5 g of 1,4-benzenediol. The internal temperature of the flask was increased up to 170° C. The flask contents were caused to react for 5 hours while the internal temperature of the flask was kept at 170° C. The internal temperature of the flask was increased up to 210° C. The flask contents were caused to react for 1.5 hours while the internal temperature of the flask was kept at 210° C. The internal pressure of the flask was reduced to 8 kPa. The flask contents were caused to further react for 1 hour at the high temperature and the reduced pressure (temperature: 210° C., pressure: 8 kPa).

The internal pressure of the flask was restored to normal pressure. Then, 69.0 g (2.8 parts by mole) of styrene and 54.0 g (2.2 parts by mole) of n-butyl methacrylate were added into the flask. The flask contents were caused to react for 1.5 hours while the internal temperature of the flask was kept at 210° C. The internal pressure of the flask was reduced to 8 kPa. The flask contents were caused to further react for 1 hour at the high temperature and the reduced pressure (temperature: 210° C., pressure: 8 kPa). Through the above, a crystalline polyester resin PES-2 was obtained. The crystalline polyester resin PES-2 had Tm of 88.8° C., a melting point (Mp) of 82° C., an acid value of 3.1 mgKOH/g, a hydroxyl value of 19.0 mgKOH/g, Mn of 3,620, and Mw of 27,500.

(Synthesis Method for Styrene-Acrylic Acid-based Resin SA-1)

A four-necked flask (capacity: 5 L) equipped with a thermometer (more specifically, a thermocouple), a drainage tube, a nitrogen inlet tube, and a stirrer was charged with 2 L of ion exchanged water and 5.0 g of tribasic calcium phosphate (product of TAIHEI CHEMICAL INDUSTRIAL CO.). Then, 700.0 g of styrene, 270.0 g of n-butyl acrylate, 4.5 g of divinylbenzene, 30.0 g of 2-hydroxyethyl methacrylate, and an oil phase were added while the flask contents were stirred at a rotational speed of 50 rpm. In the oil phase, 15.0 g of 2,2'-azobis(2,4-dimethylvaleronitrile) was dissolved in 25.0 g of diethylene glycol. The internal temperature of the flask was increased up to 80° C. The flask contents were caused to polymerize for 8 hours while the internal temperature of the flask was kept at 80° C. Through the above, a styrene-acrylic acid-based resin SA-1 in the form of beads was obtained. The styrene-acrylic acid-based resin SA-1 had Tm of 110.8° C., Tg of 42.9° C., an acid value of 0.0 mgKOH/g, a hydroxyl value of 13.0 mgKOH/g, Mn of 3,500, and Mw of 143,900.

(Synthesis Method for Styrene-Acrylic Acid-based Resin SA-2)

The amount of styrene was changed from 700.0 g to 730.0 g. Also, 2-hydroxyethyl methacrylate was not added into the four-necked flask. A styrene-acrylic acid-based resin SA-2 was synthesized by the same synthesis method as that for the styrene-acrylic acid-based resin SA-1 in all aspects other than the above changes. The obtained styrene-acrylic acid-based resin SA-2 had Tm of 110.3° C., Tg of 41.5° C., an acid value of 0.0 mgKOH/g, a hydroxyl value of 0.0 mgKOH/g, Mn of 2,740, and Mw of 120,263.

[Measurement Method for Hydroxyl Values of Binder Resins]

A hydroxyl value was measured for each of the binder resins in accordance with a method specified in "JIS K0070-1992". Note that 20 g of the binder resin was used as a measurement sample. In measurement of hydroxyl values of the non-crystalline polyester resin PES-1 and the crystalline polyester resin PES-2, a liquid mixture of acetone and toluene [acetone:toluene=1:1 (volume ratio)] was used as a solvent in which the measurement sample was dissolved. In measurement of hydroxyl values of the styrene-acrylic acid-based resin SA-1 and the styrene-acrylic acid-based resin SA-2, a liquid mixture of diethyl ether and ethanol [diethyl ether:ethanol=2:1 (volume ratio)] was used as a solvent in which the measurement sample was dissolved. Measurement results are shown in Table 3.

[Production Method for External Additive Suspensions]

(Production Method for External Additive Suspension E-1)

A round bottom flask equipped with an anchor type stirring impeller was charged with 60.0 parts by mass of styrene, 25.0 parts by mass of methyl methacrylate, 5.0 parts by mass of 2-hydroxyethyl methacrylate, 10.0 parts by mass of divinylbenzene, 4.5 parts by mass of potassium peroxodisulfate (water-soluble polymerization initiator), and 100.0 parts by mass of ion exchanged water. The internal temperature of the round bottom flask was increased up to 70° C. while the flask contents were stirred at a rotational speed of 100 rpm. The flask contents were caused to emulsion polymerize for 8 hours while the internal temperature of the flask was kept at 70° C. Through the above, a dispersion of organic fine particles was obtained. The obtained dispersion was filtered and a solid collected through filtration was washed. The washed solid was dispersed in an aqueous sodium alkyl ether sulfate solution (concentration: 10% by mass). Through the above, an external additive suspension E-1 (solid concentration: 8% by mass) was obtained.

(Production Method for External Additive Suspension E-2)

A round bottom flask equipped with an anchor type stirring impeller was charged with 62.0 parts by mass of styrene, 25.0 parts by mass of methyl methacrylate, 3.0 parts by mass of 2-hydroxyethyl methacrylate, 10.0 parts by mass of divinylbenzene, 4.5 parts by mass of potassium peroxodisulfate (water-soluble polymerization initiator), and 100.0 parts by mass of ion exchanged water. Thereafter, the same procedures as those performed in production of the external additive suspension E-1 were performed, whereby an external additive suspension E-2 was obtained.

(Production Method for External Additive Suspension E-3)

A round bottom flask equipped with an anchor type stirring impeller was charged with 60.0 parts by mass of styrene, 30.0 parts by mass of methyl methacrylate, 10.0 parts by mass of divinylbenzene, 4.5 parts by mass of potassium peroxodisulfate (water-soluble polymerization initiator), and 100.0 parts by mass of ion exchanged water. Thereafter, the same procedures as those performed in production of the external additive suspension E-1 were performed, whereby an external additive suspension E-3 was obtained.

[Measurement Method for Physical Property Values of External Addition Resin Particles]

A hydroxyl value of external addition resin particles included in each of the external additive suspensions E-1 to E-3 was measured by the method described above in [Measurement Method for Hydroxyl Values of Binder Resins]. Measurement results are shown in Table 5. Also, a number average primary particle diameter of each type of the external addition resin particles was measured using a field emission scanning electron microscope (FE-SEM) ("JSM-7600F" manufactured by JEOL Ltd.). Measurement results are shown in Table 5. Also, a glass transition point (Tg) of each type of the external addition resin particles was measured using a differential scanning calorimeter ("DSC-6220" manufactured by Seiko Instruments Inc.). Measurement results are shown in Table 5.

Note that each type of the external addition resin particles had a sharp particle size distribution. More specifically, the external addition resin particles included in the external additive suspension E-1 substantially included only styrene-acrylic acid-based resin particles having a particle diameter of approximately 28 nm. The external addition resin particles included in the external additive suspension E-2 substantially included only styrene-acrylic acid-based resin particles having a particle diameter of approximately 28 nm. The external addition resin particles included in the external additive suspension E-3 substantially included only styrene-acrylic acid-based resin particles having a particle diameter of approximately 32 nm.

[Production Methods for Shell Suspensions]

(Production Method for Shell Suspension S-1)

A reaction vessel (capacity: 5 L) equipped with a thermometer (more specifically, a thermocouple), a cooling tube, a nitrogen inlet tube, and a stirring impeller was charged with 240 g of n-propanol (NPA), 27 g of N-methylolacrylamide (N-MAM), and 63 g of methyl methacrylate (MMA). The internal temperature of the reaction vessel was increased up to 65° C. while nitrogen was introduced into the reaction vessel. An organic solution (radical polymerization initiator) was dripped into the reaction vessel over 3 hours. In the organic solution, 3 g of t-hexylperoxypivalate diluted with hydrocarbon ("PERHEXYL (registered Japanese trademark) PV" manufactured by NOF Corporation) was dissolved in 40 g of n-propanol. The vessel contents reacted (polymerized) by keeping the internal temperature of the reaction vessel at 65° C. for 5 hours. The internal temperature of the reaction vessel was increased up to 80° C. The internal temperature of the reaction vessel was kept at 80° C. for 1 hour to cause the vessel contents to further react (polymerize). Thereafter, the internal temperature of the reaction vessel was increased up to 140° C. and the internal pressure of the reaction vessel was reduced to 10 kPa to remove a solvent component from the vessel contents. The vessel contents (solid) were pulverized to obtain a coarsely pulverized product.

The coarsely pulverized product was pulverized using a mechanical pulverizer ("Turbo Mill T250" manufactured by FREUND-TURBO CORPORATION) under a condition of a set particle diameter of 10 μm. Then, 100 g of the resultant finely pulverized product, 1 g of a cationic surfactant ("QUARTAMIN (registered Japanese trademark) 24P" manufactured by Kao Corporation, 25% by mass aqueous lauryltrimethylammonium chloride solution), and 25 g of aqueous sodium hydroxide solution (concentration: 0.1 N) were mixed. An appropriate amount of ion exchanged water was added to the resultant dispersion to obtain a slurry (entire amount: 400 g). The slurry was placed in a pressure-resistant round bottom vessel made of stainless steel. The slurry was subjected to sheer dispersion for 30 minutes using a high-speed shear emulsification device ("CLEARMIX (registered Japanese trademark) CLM-2.2S" manufactured by M Technique Co., Ltd.) under a condition of a rotor rotational speed of 20,000 rpm in an environment at a high temperature (140° C.) and a high pressure (0.5 MPa). The vessel contents were stirred at a rotor rotational speed of 15,000 rpm while the vessel contents were cooled at a cooling rate of 5° C./minute until the internal temperature of the vessel reached 50° C. Through the above, a shell suspension S-1 was obtained.

(Production Method for Shell Suspension S-2)

The amount of N-methylolacrylamide was changed from 27 g to 9 g. The amount of methyl methacrylate was changed from 63 g to 81 g. A shell suspension S-2 was produced by the same production method as that for the shell suspension S-1 in all aspects other than the above changes.

(Production Method for Shell Suspension S-3)

The amount of N-methylolacrylamide was changed from 27 g to 45 g. The amount of methyl methacrylate was changed from 63 g to 45 g. A shell suspension S-3 was produced by the same production method as that for the shell suspension S-1 in all aspects other than the above changes.

(Production Method for Shell Suspension S-4)

A reaction vessel (capacity: 5 L) equipped with a thermometer (more specifically, a thermocouple), a cooling tube, a nitrogen inlet tube, and a stirring impeller was charged with 240 g of n-propanol (NPA), 27 g of N-methylolacrylamide (N-MAM), 49.5 g of methyl methacrylate (MMA), and 13.5 g of styrene. Thereafter, the same procedures as those performed in production of the shell suspension S-1 were performed, whereby a shell suspension S-4 was obtained.

(Production Method for Shell Suspension S-5)

A reaction vessel (capacity: 5 L) equipped with a thermometer (more specifically, a thermocouple), a cooling tube, a nitrogen inlet tube, and a stirring impeller was charged with 240 g of n-propanol (NPA), 27 g of N-methylolacrylamide (N-MAM), and 63 g of styrene. Thereafter, the same procedures as those performed in production of the shell suspension S-1 were performed, whereby a shell suspension S-5 was obtained.

(Production Method for Shell Suspension S-6)

The amount of N-methylolacrylamide was changed from 27 g to 4.5 g. The amount of methyl methacrylate was changed from 63 g to 85.5 g. A shell suspension S-6 was produced by the same production method as that for the shell suspension S-1 in all aspects other than the above changes.

[Measurement Methods for Physical Property Values of Shell Resin Particles]

A number average primary particle diameter of each type of shell resin particles was measured using a field emission scanning electron microscope (FE-SEM) ("JSM-7600F" manufactured by JEOL Ltd.). Measurement results are shown in Table 4.

Note that each type of the shell resin particles had a sharp particle size distribution. More specifically, the shell resin particles included in the respective shell suspensions S-1 to S-6 substantially included only vinyl resin particles having a particle diameter of approximately 130 nm.

[Production Methods for Toners]

<Production Method for Toner TA-1>

First, toner cores C-1 were produced. Specifically, 80.0 parts by mass of the non-crystalline polyester resin PES-1, 20.0 parts by mass of the crystalline polyester resin PES-2, 5.0 parts by mass of an ester wax ("NISSAN ELECTOL (registered Japanese trademark) WEP-3" manufactured by NOF Corporation), and 6.0 parts by mass of carbon black ("MA100" manufactured by Mitsubishi Chemical Corporation) were mixed using an FM mixer ("FM-20B" manufactured by Nippon Coke & Engineering Co., Ltd.).

The resultant mixture was melt-kneaded using a twin-screw extruder ("PCM-30" manufactured by Ikegai Corp.) under conditions of a material feeding rate of 6 kg/hour, a shaft rotational speed of 160 rpm, and a set temperature (cylinder temperature) of 120° C. The resultant melt-kneaded product was cooled. The cooled melt-kneaded product was coarsely pulverized using a pulverizer ("ROTOPLEX (registered Japanese trademark)" manufactured by Hosokawa Micron Corporation). The resultant coarsely pulverized product was finely pulverized using a pulverizer ("Turbo Mill Type RS" manufactured by FREUND-TURBO CORPORATION). The resultant finely pulverized product was classified using a classifier ("Elbow Jet Type EJ-LABO" manufactured by Nittetsu Mining Co., Ltd.). Through the above, the toner cores C-1 having a volume median diameter ($D_{50}$) of 7.0 μm were obtained.

Next, composite particles were produced. Specifically, a three-necked flask (capacity: 1 L) equipped with a thermometer and a stirring impeller was charged with 300.0 g of the toner cores C-1, 1.5 g of an anionic surfactant ("EMAL (registered Japanese trademark) 0" manufactured by Kao Corporation), and 300 mL of ion exchanged water. The flask was set in a water bath and the internal temperature of the flask was kept at 30° C. using the water bath. Then, pH of the flask contents was adjusted to 4 by adding 2 g of an aqueous hydrochloric acid solution (concentration: 2 N) into the flask.

Then, 160 g of the shell suspension S-1 and 75 g of the external additive suspension E-1 were added into the flask. At this time, the amount of the external additive suspension E-1 was adjusted such that an amount of a solid content of the external additive suspension E-1 was 2.0 parts by mass relative to 100 parts by mass of toner mother particles. Thereafter, the flask contents were stirred for 15 minutes at a rotational speed of 350 rpm. The flask contents were heated at a heating rate of 0.2° C./minute using the water bath until the internal temperature of the flask reached 60° C. The flask contents were stirred for 120 minutes at a rotational speed of 350 rpm while the internal temperature of the flask was kept at 60° C. using the water bath. The shell resin particles were formed into a film on a surface of each toner core through the internal temperature of the flask being kept at 60° C. Also, the external addition resin particles were attached to a surface of each shell layer. Thereafter, the flask was taken out of the water bath and the flask contents were cooled at a cooling rate of 10° C./minute until the internal temperature of the flask reached 25° C. Then, pH of the flask contents was adjusted to 7 by adding an aqueous sodium hydroxide solution (concentration: 0.1 N) into the flask. Through the above, a dispersion was obtained.

The dispersion was subjected to suction filtration using a Buchner funnel. The resultant wet cake of composite particles was re-dispersed in ion exchanged water. The resultant dispersion was subjected to suction filtration using a Buchner funnel. Solid-liquid separation as above was repeated five times.

Particles (composite particles) obtained through solid-liquid separation were dispersed in an aqueous ethanol solution (concentration: 50% by mass). Through the above, a slurry was obtained. The composite particles in the slurry were dried using a continuous type surface modifier ("COATMIZER (registered Japanese trademark)" manufactured by Freund Corporation) under conditions of a hot air temperature of 45° C. and a blower flow rate of 2 $m^3$/minute. Mechanical treatment (specifically, treatment for applying shear force) was performed on the composite particles using a hermetic flow mixer ("FM-20C/I" manufactured by Nippon Coke & Engineering Co., Ltd.) under conditions of a rotational speed of 3,000 rpm, a jacket temperature of 20° C., and a treatment time of 10 minutes. Through the above, particles constituted by a plurality of the composite particles were obtained.

Subsequently, external addition was performed. Specifically, 100.0 parts by mass of the composite particles, 1.2 parts by mass of hydrophobic silica particles ("AEROSIL (registered Japanese trademark) RA-200H" manufactured by Nippon Aerosil Co., Ltd.), and 0.8 parts by mass of conductive titanium oxide particles ("EC-100" manufactured by Titan Kogyo, Ltd.) were loaded into an FM mixer ("FM-10B" manufactured by Nippon Coke & Engineering Co., Ltd.). The composite particles, the hydrophobic silica particles, and the conductive titanium oxide particles were mixed under conditions of a rotational speed of 3,000 rpm, a jacket temperature of 20° C., and a treatment time of 2 minutes. Through the above, the toner TA-1 including a number of toner particles was obtained.

<Production Method for Toner TA-2>

The amount of the external additive suspension E-1 was adjusted such that an amount of a solid content of the external additive suspension E-1 was 1.5 parts by mass relative to 100 parts by mass of toner mother particles. More specifically, 56 g of the external additive suspension E-1 was added into the flask. The toner TA-2 was produced by the same production method as that for the toner TA-1 in all aspects other than the above change.

<Production Method for Toner TA-3>

The amount of the external additive suspension E-1 was adjusted such that an amount of a solid content of the external additive suspension E-1 was 2.3 parts by mass relative to 100 parts by mass of toner mother particles. More specifically, 86 g of the external additive suspension E-1 was added into the flask. The toner TA-3 was produced by the same production method as that for the toner TA-1 in all aspects other than the above change.

<Production Methods for Toners TA-4 to TA-7>

The toners TA-4 to TA-7 were produced by the same production method as that for the toner TA-1 in all aspects other than that the shell suspensions S-2 to S-5 were respectively used.

<Production Method for Toner TA-8>

The toner TA-8 was produced by the same production method as that for the toner TA-1 in all aspects other than that toner cores C-2 were used. The toner cores C-2 were produced by the following method. Specifically, the toner cores C-2 were produced by the same production method as that for the toner cores C-1 in all aspects other than that 100.0 parts by mass of the styrene-acrylic acid-based resin SA-1 was used instead of 80.0 parts by mass of the non-crystalline polyester resin PES-1 and 20.0 parts by mass of the crystalline polyester resin PES-2.

<Production Method for Toner TA-9>

The toner TA-9 was produced by the same production method as that for the toner TA-1 in all aspects other than that the external additive suspension E-2 was used.

<Production Method for Toner TB-1>

The amount of the external additive suspension E-1 was adjusted such that an amount of a solid content of the external additive suspension E-1 was 2.5 parts by mass relative to 100 parts by mass of toner mother particles. More specifically, 94 g of the external additive suspension E-1 was added into the flask. The toner TB-1 was produced by the same production method as that for the toner TA-1 in all aspects other than the above change.

<Production Method for Toner TB-2>

The toner TB-2 was produced by the same production method as that for the toner TA-1 in all aspects other than that the shell suspension S-6 was used.

<Production Method for Toner TB-3>

The toner TB-3 was produced by the same production method as that for the toner TA-1 in all aspects other than that toner cores C-3 were used. The toner cores C-3 were produced by the following method. Specifically, the toner cores C-3 were produced by the same production method as that for the toner cores C-1 in all aspects other than that 100.0 parts by mass of the styrene-acrylic acid-based resin SA-2 was used instead of 80.0 parts by mass of the non-crystalline polyester resin PES-1 and 20.0 parts by mass of the crystalline polyester resin PES-2.

<Production Method for Toner TB-4>

The toner TB-4 was produced by the same production method as that for the toner TA-1 in all aspects other than that the external additive suspension E-3 was used.

[Evaluation Methods for Toners]

<Evaluation Method of Heat Resistance for Toners>

First, 3 g of a toner (one of the toners TA-1 to TA-9 and TB-1 to TB-4) was put into a polyethylene container (capacity: 20 mL) and the container was then sealed. The sealed container was left to stand in a thermostatic chamber (set temperature: 58° C.) for 3 hours. Thereafter, the container was taken out of the thermostatic chamber and cooled to room temperature (approximately 25° C.), whereby an evaluation toner was obtained.

The obtained evaluation toner was placed on a 200-mesh sieve (opening: 75 μm) of a known mass. A mass of the sieve including the evaluation toner thereon was measured to determine a mass of the toner before sifting. The sieve was set in POWDER TESTER (registered Japanese trademark, product of Hosokawa Micron Corporation) and shaken for 30 seconds at a rheostat level of 5 in accordance with a manual of POWDER TESTER to sift the evaluation toner. After the sifting, a mass of toner that did not pass through the sieve was measured. An aggregation rate (unit: %) was determined by the following equation based on the mass of the toner before sifting and the mass of the toner after sifting. Note that "mass of toner after sifting" in the following equation is the mass of the toner that did not pass through the sieve and left on the sieve after the sifting.

Aggregation rate=100×mass of toner after sifting/mass of toner before sifting

Evaluation criteria are shown below. Evaluation results are shown in Table 6.

Excellent: Aggregation rate was equal to or lower than 10%.

Good: Aggregation rate was higher than 10% and equal to or lower than 20%

<Evaluation Method for Low-Temperature Fixability of Toner>

(Preparation Method for Evaluation Target)

A toner (one of the toners TA-1 to TA-9 and TB-1 to TB-4) and a carrier (carrier for "TASKalfa5550ci" manufactured by KYOCERA Document Solutions Inc.) of respective amounts were loaded into a ball mill such that a toner content was 10% by mass. The toner and the carrier were then mixed for 30 minutes. Through the above, an evaluation target was obtained.

(Preparation Method for Evaluation Apparatus)

An evaluation apparatus used was a multifunction peripheral ("FS-05250DN" manufactured by KYOCERA Document Solutions Inc.) modified such that a fixing temperature was adjustable. The evaluation target (unused) was loaded into a development device of the evaluation apparatus and a toner for replenishment use (unused) was loaded into a toner container of the evaluation apparatus. Here, the same toner as that contained in the evaluation target was used as the toner for replenishment use. The evaluation apparatus was prepared as described above.

(Measurement of Lowest Fixing Temperature)

A lowest fixing temperature was measured by the following method. Here, the term lowest fixing temperature refers to a lowest temperature among fixing temperatures for which it was determined that cold offset did not occur.

Specifically, development bias of the evaluation apparatus was adjusted such that a toner application amount to recording paper was 1.0 mg/cm$^2$. An unfixed solid image was formed on printing paper (printing paper of 90 g/m$^2$) while the printing paper was conveyed at a linear velocity of 200 mm/second.

The printing paper with the unfixed solid image formed thereon was passed through a fixing device of the evaluation apparatus. At this time, the temperature of the fixing device of the evaluation apparatus (specifically, the temperature of a fixing roller included in the fixing device of the evaluation apparatus) was increased from 100° C. in increments of 5° C. to increase the fixing temperature within a range from 100° C. to 200° C. in increments of 5° C. Through the above, solid images (21 images) fixed at respective fixing temperatures were obtained.

Whether or not cold offset occurred was determined by performing a fold-rubbing test for each of the obtained solid images. Specifically, the printing paper with the solid image fixed thereto was folded in half such that a surface on which the solid image had been fixed was folded inward. Then, a 1-kg weight covered with cloth was rubbed back and forth on a fold of the printing paper five times. Thereafter, the printing paper was opened up and a length of peeling of the toner (hereinafter referred to as a "peeling length") was measured in a folded portion of the printing paper to which the solid image had been fixed. When the peeling length was shorter than 1.0 mm, it was determined that cold offset did not occur. When the peeling length was equal to or longer than 1.0 mm, it was determined that cold offset occurred. The lowest fixing temperature was determined as described above.

Evaluation criteria are shown below. Evaluation results are shown in Table 6.

Excellent: Lowest fixing temperature was equal to or lower than 145° C.

Good: Lowest fixing temperature was higher than 145° C. and equal to or lower than 155° C.

Poor: Lowest fixing temperature was higher than 155° C.

<Evaluation Method for Presence or Absence of Contamination by External Addition Resin Particles>

An evaluation target used was that prepared in <Evaluation Method for Low-temperature Fixability of Toner>. An evaluation apparatus used was a multifunction peripheral ("TASKalfa5550ci" manufactured by KYOCERA Document Solutions Inc.). The evaluation target (unused) was loaded into a development device of the evaluation apparatus and a toner for replenishment use (unused) was loaded into a toner container of the evaluation apparatus. Here, the same toner as that contained in the evaluation target was used as the toner for replenishment use. The evaluation apparatus was prepared as described above.

A printing durability test was performed by printing a sample image with a printing rate of 5% on successive 20,000 sheets of printing paper (A4 size) using the evaluation apparatus in an environment at a temperature of 32° C. and a relative humidity of 80%. In doing so, until the number of sheets on which the sample image was printed reached 1,000 sheets, a solid image was output after each time the sample image was printed on 200 sheets of the printing paper. Once the number of sheets on which the sample image was printed exceeded 1,000 sheets, a solid image was output after each time the sample image was printed on 1,000 sheets of the printing paper. Each time the solid image was output, a development sleeve was taken out of the evaluation apparatus and whether or not extraneous matter was present on a surface of the development sleeve was visually observed.

Evaluation criteria are shown below. Evaluation results are shown in Table 6.

Good: No extraneous matter was observed on the surface of the development sleeve even when the number of sheets on which the sample image was printed reached 20,000 sheets.

Poor: Extraneous matter was observed on the surface of the development sleeve until the number of sheets on which the sample image was printed reached 20,000 sheets.

<Evaluation Method of Detachment Rate for External Addition Resin Particles>

A measurement sample was prepared by adding 2 g of a toner (one of the toners TA-1 to TA-9 and TB-1 to TB-4) to 500 mL of an aqueous solution of a surfactant. The aqueous solution of the surfactant contained ion exchanged water and 0.2% by mass of sodium alkyl ether sulfate.

The measurement sample was dehydrated by suction using filter cloth (opening size: 2 μm) and thereafter dried using a vacuum oven. An infrared (IR) absorption spectrum of the measurement sample was measured using a Fourier transform infrared (FT-IR) spectrometer ("Spectrum One (Frontier series)" manufactured by PerkinElmer Japan Co., Ltd.). A peak area of a peak derived from the external addition resin was calculated from the obtained IR absorption spectrum. An initial peak area was obtained as described above.

The measurement sample was irradiated with ultrasonic waves (high-frequency output: 100 W, oscillation frequency: 50 kHz) for 10 minutes using an ultrasonic liquid mixer ("Super Sonic VS-F100" sold by AS ONE Corporation). Thereafter, a post-irradiation peak area was obtained by the same method as that for obtaining the initial peak area. A detachment rate of external addition resin particles (unit: %) was determined by the following equation based on the initial peak area and the post-irradiation peak area.

Detachment rate of external addition resin particles= (initial peak area−post-irradiation peak area)× 100/initial peak area (A)

Evaluation criteria are shown below. Evaluation results are shown in Table 6.

Good: Detachment rate of external addition resin particles was lower than 5%.

Poor: Detachment rate of external addition resin particles was equal to or higher than 5%.

[Evaluation Results of Toners]

Evaluation results are shown in Table 6. In Table 6, whether or not extraneous matter was observed on the surface of the development sleeve is indicated in the column under "Presence of extraneous matter". When no extraneous matter was observed on the surface of the development sleeve even when the number of sheets on which the sample image was printed reached 20,000 sheets, "No" is indicated in the above column. When extraneous matter was observed on the surface of the development sleeve until the number of sheets on which the sample image was printed reached 20,000 sheets, "Yes" is indicated in the above column. Also, a detachment rate of each type of external addition resin particles (calculation result) is shown in the column titled "Detachment rate".

TABLE 6

| | Toner | Aggregation rate (%) | Lowest fixing temperature (° C.) | Presence of extraneous matter | Detachment rate (%) |
|---|---|---|---|---|---|
| Example 1 | TA-1 | 7 (Excellent) | 150 (Good) | No (Good) | 3.5 (Good) |
| Example 2 | TA-2 | 10 (Excellent) | 145 (Excellent) | No (Good) | 2.1 (Good) |
| Example 3 | TA-3 | 5 (Excellent) | 155 (Good) | No (Good) | 4.9 (Good) |
| Example 4 | TA-4 | 11 (Good) | 145 (Excellent) | No (Good) | 4.5 (Good) |
| Example 5 | TA-5 | 4 (Excellent) | 155 (Good) | No (Good) | 1.0 (Good) |
| Example 6 | TA-6 | 9 (Excellent) | 150 (Good) | No (Good) | 3.0 (Good) |
| Example 7 | TA-7 | 3 (Excellent) | 155 (Good) | No (Good) | 4.2 (Good) |
| Example 8 | TA-8 | 8 (Excellent) | 150 (Good) | No (Good) | 3.9 (Good) |
| Example 9 | TA-9 | 13 (Good) | 145 (Excellent) | No (Good) | 4.2 (Good) |
| Comparative example 1 | TB-1 | 3 (Excellent) | 160 (Poor) | Yes (Poor) | 6.2 (Poor) |
| Comparative example 2 | TB-2 | 15 (Good) | 140 (Excellent) | Yes (Poor) | 6.0 (Poor) |
| Comparative example 3 | TB-3 | 12 (Good) | 145 (Excellent) | Yes (Poor) | 7.5 (Poor) |
| Comparative example 4 | TB-4 | 11 (Good) | 145 (Excellent) | Yes (Poor) | 9.8 (Poor) |

The toners TA-1 to TA-9 (toners according to Examples 1 to 9) each had the following features. Specifically, the toners TA-1 to TA-9 were positively chargeable and each included a plurality of toner particles. The toner particles each included a toner mother particle and an external additive. The toner mother particles each included a toner core and a shell layer. The toner core contained a binder resin. The shell layer covered a surface of the toner core. The external additive included a plurality of external addition resin particles. The external addition resin particles were each present on a surface of the shell layer. A detachment rate of the external addition resin particles was lower than 5%.

As shown in Table 6, an aggregation rate was low for each of the toners TA-1 to TA-9. In image formation performed using any of the toners TA-1 to TA-9, unfixed toner could be fixed to printing paper at a temperature equal to or lower than 155° C. In image formation performed using any of the toners TA-1 to TA-9, no extraneous matter was observed on the surface of the development sleeve even when the number of sheets on which the sample image was formed reached 20,000 sheets.

By contrast, the toners TB-1 to TB-4 (toners according to Comparative examples 1 to 4) each did not have the above features. Specifically, the detachment rate of the external addition resin particles was equal to or higher than 5% for each of the toners TB-1 to TB-4. In image formation performed using any of the toners TB-1 to TB-4, extraneous matter was observed on the surface of the development sleeve until the number of sheets on which the sample image was formed reached 20,000 sheets. Also, in image formation performed using the toner TB-1, an image could not be favorably fixed unless the fixing temperature was higher than 155° C.

What is claimed is:

1. A toner comprising a plurality of toner particles, the toner being positively chargeable, wherein the toner particles each include a toner mother particle and an external additive, the toner mother particle includes a toner core containing a binder resin and a shell layer covering a surface of the toner core, the external additive includes a plurality of resin particles containing a resin, the resin particles are each present on a surface of the shell layer, the shell layer contains a vinyl resin, the vinyl resin includes a constitutional unit represented by a formula (1-1) shown below, a constitutional unit represented by a formula (1-2) shown below, and a constitutional unit represented by a formula (1-3) shown below, an atomic group $X^1$ included in the constitutional unit represented by the formula (1-1) and an atomic group $X^2$ included in the constitutional unit represented by the formula (1-2) are each derived from an N-methylol group and represented by —$NHCH_2O$—, an available bond of an oxygen atom located at a terminal of the atomic group $X^1$ is connected to an atom constituting the binder resin, an available bond of an oxygen atom located at a terminal of the atomic group $X^2$ is connected to an atom constituting the resin contained in the resin particles, the toner core and each of the resin particles are bonded together through a covalent bond within the shell layer, the covalent bond includes the atomic group $X^1$ and the atomic group$X_2$, a detachment rate of the resin particles from the toner mother particles is lower than 5%, a method for measuring the detachment rate includes:

preparing a first measurement solution by adding 2 g of the toner to 500 mL of a first aqueous solution of a surfactant;

preparing a first measurement sample by drying, after dehydrating the first measurement solution by suction using filter cloth having an opening size of 2 μm, the first measurement solution using a vacuum oven;

calculating a peak area (initial peak area) of a peak derived from the resin particles from an IR absorption spectrum of the first measurement sample, the IR absorption spectrum of the first measurement sample being plotted using a Fourier transform infrared spectrometer;

preparing a second measurement solution by adding 2 g of the toner to 500 mL of a second aqueous solution of the surfactant;

irradiating the second measurement solution with ultrasonic waves at a high-frequency output of 100 W and an oscillation frequency of 50 kHz for 10 minutes using an ultrasonic liquid mixer;

preparing a second measurement sample by drying, after dehydrating the second measurement solution by suction using filter cloth having an opening size of 2 μm, the second measurement solution using a vacuum oven;

calculating a peak area (post-irradiation peak area) of a peak derived from the resin particles from an IR absorption spectrum of the irradiate second measurement sample, the IR absorption spectrum of the irradiated second measurement sample being plotted using a Fourier transform infrared spectrometer; and obtaining the detachment rate of the resin particles according to an equation (A) below, and the first aqueous solution of the surfactant and the second aqueous solution of the surfactant each contain ion exchanged water and 0.2% by mass of sodium alkyl ether sulfate, $$\text{detachment rate of resin particles} = (\text{initial peak area} - \text{post-irradiation peak area}) \times 100 / \text{initial peak area} \quad (A)$$

(1-1)

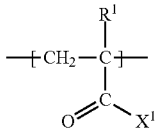

where in the formula (1-1), $R^1$ represents a hydrogen atom or an alkyl group optionally substituted with a substituent, (1-2)

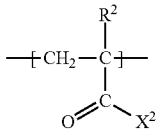

in the formula (1-2), $R^2$ represents a hydrogen atom or an alkyl group optionally substituted with a substituent, and (1-3)

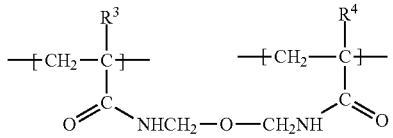

in the formula (1-3), $R^3$ and $R^4$ each represent, independently of each other, a hydrogen atom or an alkyl group optionally substituted with a substituent.

2. The toner according to claim 1, wherein the vinyl resin is a copolymer of a first monomer and a second monomer, the first monomer is at least one vinyl compound represented by a formula (1-4) shown below, each of the constitutional unit represented by the formula (1-1), the constitutional unit represented by the formula (1-2), and the constitutional unit represented by the formula (1-3) is a constitutional unit derived from the first monomer, the second monomer is at least one monomer selected from the group consisting of at least one alkyl (meth) acrylate-based monomer and at least one styrene-based monomer, and a ratio of an amount of the first monomer to a sum of the amount of the first monomer and an amount of the second monomer is at least 10% by mass and no greater than 60% by mass, (1-4)

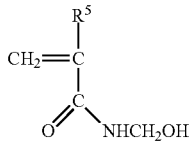

where in the formula (1-4), $R^5$ represents a hydrogen atom or an alkyl group optionally substituted with a substituent.

3. The toner according to claim 2, wherein the vinyl resin, a unit derived from a homopolymer of the second monomer or a unit derived from a copolymer of monomers including the second monomer is cross-linked by at least one constitutional unit selected from the group consisting of the constitutional unit represented by the formula (1-1), the constitutional unit represented by the formula (1-2), and the constitutional unit represented by the formula (1-3).

4. The toner according to claim 1, wherein the binder resin includes at least one resin having a hydroxyl value of at least 1 mgKOH/g and no greater than 50 mgKOH/g, and the resin particles each contain at least one resin having a hydroxyl value of at least 1 mgKOH/g and no greater than 30 mgKOH/g.

5. The toner according to claim 4, wherein the binder resin includes at least one resin selected from the group consisting of a polyester resin having a hydroxyl value of at least 1 mgKOH/g and no greater than 50 mgKOH/g and a styrene-acrylic acid-based resin having a hydroxyl value of at least 1 mgKOH/g and no greater than 50 mgKOH/g.

6. The toner according to claim 1, wherein the constitutional unit represented by the formula (1-1) is represented by a formula (1-1A) shown below, in the formula (1-1A), $R^1$ represents a hydrogen atom or an alkyl group optionally substituted with a substituent, and an available bond of an oxygen atom is connected to an atom constituting the binder resin, the constitutional unit represented by the formula (1-2) is represented by a formula (1-2A) shown below, and in the formula (1-2A), $R^2$ represents a hydrogen atom or an alkyl group optionally substituted with a substituent, and an available bond of an oxygen atom is connected to an atom constituting the resin contained in the resin particles (1-1A)

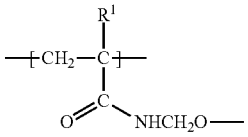

(1-2A)

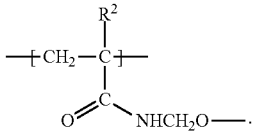

7. The toner according to claim 1, wherein the vinyl resin includes a constitutional unit represented by a formula (1-5) shown below, (1-5)

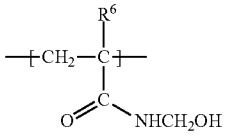

where in the formula (1-5), $R^6$ represents a hydrogen atom or an alkyl group optionally substituted with a substituent.

8. The toner according to claim 1, wherein an amount of the resin particles is at least 0.1 parts by mass and no greater than 2.5 parts by mass relative to 100 parts by mass of the toner mother particles.

* * * * *